US005829057A

United States Patent [19]

Gunn

[11] Patent Number: 5,829,057

[45] **Date of Patent: *Nov. 3, 1998**

[54] LOW FRICTION OUTER APPAREL

[75] Inventor: Robert T. Gunn, 360 E. 65th St. Apt. 11E, New York, N.Y. 10021

[73] Assignee: Robert T. Gunn, New York, N.Y.

[ * ] Notice: The term of this patent shall not extend beyond the expiration date of Pat. No. 5,590,420.

[21] Appl. No.: 389,759

[22] Filed: Feb. 14, 1995

Related U.S. Application Data

[63] Continuation-in-part of Ser. No. 217,490, Mar. 24, 1994, Pat. No. 5,590,420.

[51] Int. Cl.[6] ..... A41D 13/00

[52] U.S. Cl. ..... 2/69; 2/239; 2/67; 2/159; 2/227; 2/115; 2/243.1

[58] Field of Search ..... 2/239, 69, 243.1, 2/904, 902, 168, 158, 161.7, 161.1, 167, 46, 48, 51, 50, 81, 83, 114, 22, 16; 36/138, 43, 44, 35, 72 R

[56] References Cited

U.S. PATENT DOCUMENTS

| | | |
|---|---|---|
| 3,328,100 | 6/1967 | Spokes et al. . |
| 3,590,881 | 7/1971 | Van Amburg . |
| 3,749,138 | 7/1973 | Rheaume et al. . |
| 3,844,826 | 10/1974 | Buchner et al. . |
| 4,074,512 | 2/1978 | Matt . |
| 4,152,784 | 5/1979 | McGalliard . |
| 4,153,980 | 5/1979 | Moertel . |
| 4,195,362 | 4/1980 | Rolando . |
| 4,261,061 | 4/1981 | McAlvage . |
| 4,296,499 | 10/1981 | Patterson et al. . |
| 4,550,446 | 11/1985 | Herman . |
| 4,572,174 | 2/1986 | Eilender et al. . |
| 4,805,240 | 2/1989 | Siqveland . |
| 4,843,844 | 7/1989 | Hursh et al. . |
| 4,864,669 | 9/1989 | Jones . |
| 4,922,551 | 5/1990 | Anthes . |
| 4,967,494 | 11/1990 | Johnson . |
| 5,123,113 | 6/1992 | Smith . |
| 5,154,682 | 10/1992 | Kellerman . |
| 5,260,360 | 11/1993 | Mrozinski et al. . |
| 5,271,211 | 12/1993 | Newman . |
| 5,323,815 | 6/1994 | Barbeau et al. ..... 2/81 |
| 5,376,441 | 12/1994 | Wu et al. . |
| 5,385,694 | 1/1995 | Wu et al. . |
| 5,575,012 | 11/1996 | Fox et al. . |

FOREIGN PATENT DOCUMENTS

| | | |
|---|---|---|
| 20 07 860 | 9/1971 | Germany . |
| 28 20 793 | 11/1979 | Germany . |
| 35 34 401 A1 | 4/1987 | Germany . |
| 55 06 22 01 | 5/1980 | Japan . |

OTHER PUBLICATIONS

K. Herring and D. Richie, Journal of the American Podiatric Medical Association, "Friction Blisters and Sock Fiber Composition", vol. 80/No. 2, Feb. 1990 pp. 63–71.

K. Herring and D. Richie, Journal of the American Podiatric Medical Association, "Comparison of Cotton and Acrylic Socks Using a Generic Cushion Sole Design for Runners", vol. 83/No. 9, Sep. 1993 pp. 515–522.

"DuPont PTFE 30 flouropolymer resin" (facsimile) pp. 2–5.

International Search Report for International Application No. PCT/US95/03218

*Primary Examiner*—Gloria Hale

*Attorney, Agent, or Firm*—Curtis, Morris & Safford, P.C.

[57] ABSTRACT

The present invention is an article, namely apparel, such as clothing, footwear, fabrics, and the like, which incorporates fabrics or chemicals having a low coefficient of friction either overall or in specific areas of the apparel that will minimize the development of blisters, callouses, and irritation of the skin. The present invention also is an article such as apparel which incorporates fabrics or chemicals having a low coefficient of friction either overall or in specific areas of the outer surface of the apparel that will minimize frictional contact with external objects. The invention also includes methods for producing this low friction apparel and apparel with a low friction outer surface.

64 Claims, 7 Drawing Sheets

LOW FRICTION OUTER APPAREL

RELATED APPLICATIONS

This application is a continuation-in-part of U.S. patent application Ser. No. 08/217,490 filed Mar. 24, 1994, and issued as U.S. Pat. No. 5,590,420 on Jan. 7, 1997 incorporated herein by reference.

BACKGROUND OF INVENTION

This invention relates to low friction apparel and methods for producing same, wherein apparel is defined as clothing, footwear, fabrics, and the like. More particularly, the invention relates to low friction apparel which incorporates fabrics or chemicals having a low coefficient of friction either overall or in specific areas of the apparel that will minimize the development of blisters, callouses, and irritation of an apparel wearer's body surface. The invention also includes methods for producing the low friction apparel and methods for using a low friction material to reduce the coefficient of friction of a finished article of apparel or the like to reduce irritation.

This invention further relates to apparel with a low friction outer surface and methods for producing same. More particularly, the invention relates to apparel with a low friction outer surface which incorporates fabrics or chemicals having a low coefficient of friction either overall or in specific areas of the outer surface of the apparel, such that a low friction surface will be presented on the exterior surface of the apparel. The invention also includes methods for producing the apparel with a low friction outer surface and methods for using a low friction material to reduce the coefficient of friction of the exterior of a finished article of apparel or the like.

Apparel is made out of many materials, natural and man-made. They include cotton, wool, silk, linen, leather, vinyl, nylon - polyamides and polyamide co-polymers, LYCRA SPANDEX™ in different filament configurations, orlon polyvinylidene fluoride, such as KYNAR™, polyester, for example, polyethylene terepthalate, glycol modified polyesters, such as PETG, KODURA™, rayon, orlon cellulosic fiber blends, and the like, as well as blends of the above.

Of course, apparel, either directly or indirectly, contacts the body surface of the wearer. The movement of the wearer causes frictional contact between the wearer's body surface and the apparel. This frictional contact can cause irritation, blisters, and callouses. This frictional contact is particularly a problem in sporting apparel wherein the formation of irritations, blisters, and callouses is exacerbated by the rapid and/or repetitious body movements related to the particular activity. Additionally, it is noted that most apparel has specific areas of high body surface/apparel contact which produces a majority of the irritations, blisters, and callouses.

Furthermore, the outer surface of apparel contacts external objects and surfaces such as walls, floors, furniture, and other pieces of apparel (worn by others or by the wearer). The movement of the wearer causes frictional contact between the wearer's apparel and the external objects and surfaces. This frictional contact can be, at times, be very undesirable. In general, frictional contact of any object with air, water, or solid surfaces slows or brings a moving object to a stop (or, in the case of a falling object, to terminal velocity). This frictional contact is particularly a problem in sports where a participant's bodily momentum is brought to an abrupt or sliding halt. If the bodily momentum could be dissipated such as in a sliding motion, injuries which occur in these sports could be minimized.

Another situation where frictional contact can be very undesirable, is in body contact sports. In sports which require a player to grip or tackle an opposing player, it would be advantageous to the opposing player to wear apparel which is difficult to grip. Additionally, in sports where players (either opposing players or team members) make bodily contact, it would be advantageous to minimize the effect of pushing and jostling of contact (i.e. bumping, pushing, etc.) during play.

Another situation where frictional contact can be very undesirable, is in high speed sports and sports where the difference between winning and losing is determined in fractions of a second. In these sports, any speed or momentum lost to friction can mean the difference between winning and losing.

It would be highly desirable to have apparel which has an overall low coefficient of friction or which has material having a low coefficient of friction in areas of high body surface/apparel contact such that irritations, blisters, and callouses are avoided or minimized.

It would also be highly desirable to have apparel which has an overall low coefficient of friction or which has material having a low coefficient of friction in areas of high apparel outer surface/external object contact such that frictional contact is minimized.

SUMMARY OF THE INVENTION

It is a principle object of the invention to provide low friction apparel which avoids or minimizes the development of irritations, blisters, and callouses.

A further object of the invention is to provide a method for producing low friction apparel by chemically treating the fibers or yarn or the like of the material from which the apparel is made prior to or after producing the material.

Another object of the invention is to provide a method for producing low friction apparel by incorporating low friction yarns, fibers or material into the fabric from which the apparel is made.

Still another object of the invention is to provide a method for producing low friction apparel by applying chemicals to impart a low friction coefficient directly to the fabric or apparel either overall or in areas of high body surface/apparel contact.

It is yet another principle object of the invention to provide apparel which has a low friction outer surface.

Still a further object of the invention is to provide a method for producing apparel with a low friction outer surface by chemically treating the fibers or yarn or the like of the material from which the apparel is made prior to or after producing the material.

Another object of the invention is to provide a method for producing apparel with a low friction outer surface by incorporating low friction yarns, fibers or material into the fabric from which the apparel is made.

Yet another object of the invention is to provide a method for producing apparel with a low friction outer surface by applying chemicals to impart a low friction coefficient directly to the fabric or apparel either overall or in areas of high apparel outer surface/external object contact.

DETAILED DESCRIPTION OF THE INVENTION

Figure 1:
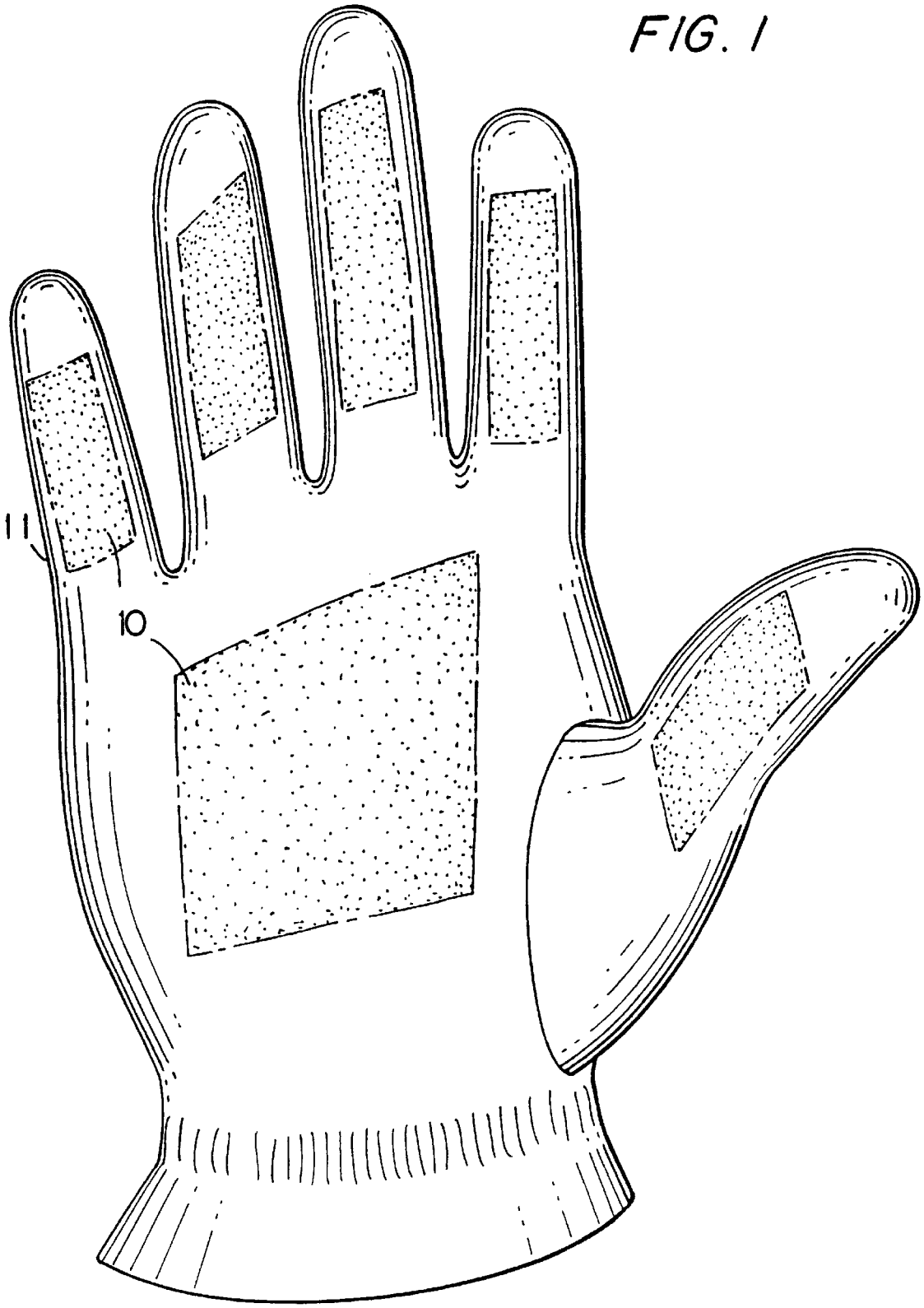
FIG. 1 is a front elevational view of a glove of the invention.

As indicated above, the present invention provides low friction apparel to avoid or minimize irritations, blisters, and callouses that can result from abrasive contact between a wearer's body surface and the apparel. Low friction apparel can be made with low friction materials (10, FIGS. 1–12B). These low friction materials can be fibers which inherently have a low coefficient of friction which are incorporated into the material either alone or in combination with other materials; low friction chemicals which can be applied directly to the finished fibers, material, or apparel to impart low friction properties; fibers which are treated with low friction chemicals then woven into the material either alone or in combination with other material; or any combination of the above. These low friction materials (10, FIGS. 1–12B) can be incorporated into the entire piece of apparel or in specific high body surface/apparel contact areas.

Some material fibers inherently have a low coefficient of friction. These fibers include, but are not limited to, silicone, graphite, TEFLON™, KYNAR™, boron, polypropylene, polyethylene, and GORTEX™. These materials can be incorporated directly into the apparel either overall or in specific high body surface/appeal contact areas to produce low friction apparel.

Chemicals can be used to treat material fibers or finished materials that do not inherently have a low coefficient of friction in order to impart a low coefficient of friction. Additionally, this chemical treatment can be used with materials which do inherently have a low coefficient of friction in order to impart an even lower coefficient of friction. This chemical treatment is incorporated into the material such that it is of a non-temporary nature. Most preferably, this chemical treatment is incorporated into the material such that it is functional substantially over the lifetime of the treated article. These chemicals include, but are not limited to, silicone, silicone copolymers, silicone elastomers, polytetrafluoroethylene, homopolymers and copolymers such as TEFLON™, graphite, and the like, as well as any combination of the above chemicals. The fibers can be treated with these chemicals by coextrusion when producing the fibers, blending with the fibers after production, adding in a bath form or spraying onto the fiber or material, or similar techniques. The finished material can be treated with these chemicals by adding in a bath form or spraying onto the material, or similar techniques.

In a typical application of the invention, a fiber, yarn or fabric or finished article (such as apparel) is treated with the low coefficient of friction material to reduce the coefficient of friction of the treated fiber, yarn, fabric or article to one which is below the coefficient of friction of the untreated fiber, yarn, fabric or finished article.

It is preferred that the coefficient of friction of the treated object be less than about 80%, preferably less than about 60% and most preferably less than about 50% of the coefficient of friction of the untreated object.

If the low friction material is incorporated into the finished article or fabric by weaving a low friction fiber or yarn into the article or fabric, the low friction fiber or yarn can be incorporated into amounts ranging from 5% to 95% by weight of the treated area. Preferably, the fiber or yarn is incorporated in amounts between 30 and 70% by weight of the treated area. Most preferably, these amounts are 30 to 50%, by weight.

It is of course understood that when finished material is treated with chemicals to impart a low coefficient of friction, in particular when spraying onto the material, the amount incorporated into the finished material can be as small as a fraction of a percent by weight of the treated area.

The addition of the low friction material to the fiber, yarn, fabric or article can also be useful to wick away moisture from the skin to help guard against irritation, as well as wetness.

It is preferred that areas of objects treated are typically areas which would ordinarily come in contact with the skin during use. Furthermore, it would be preferred that areas treated be those areas subject to imparting frictional movement against the skin during use.

It is preferred also that the coefficient of friction between the treated area of the object and the body surface to be reduced to below about 0.9. Most preferably, the coefficient of friction is reduced to below about 0.6.

The following examples are set forth to illustrate specific embodiments of the invention for low friction apparel.

EXAMPLE 1

Figure 3:
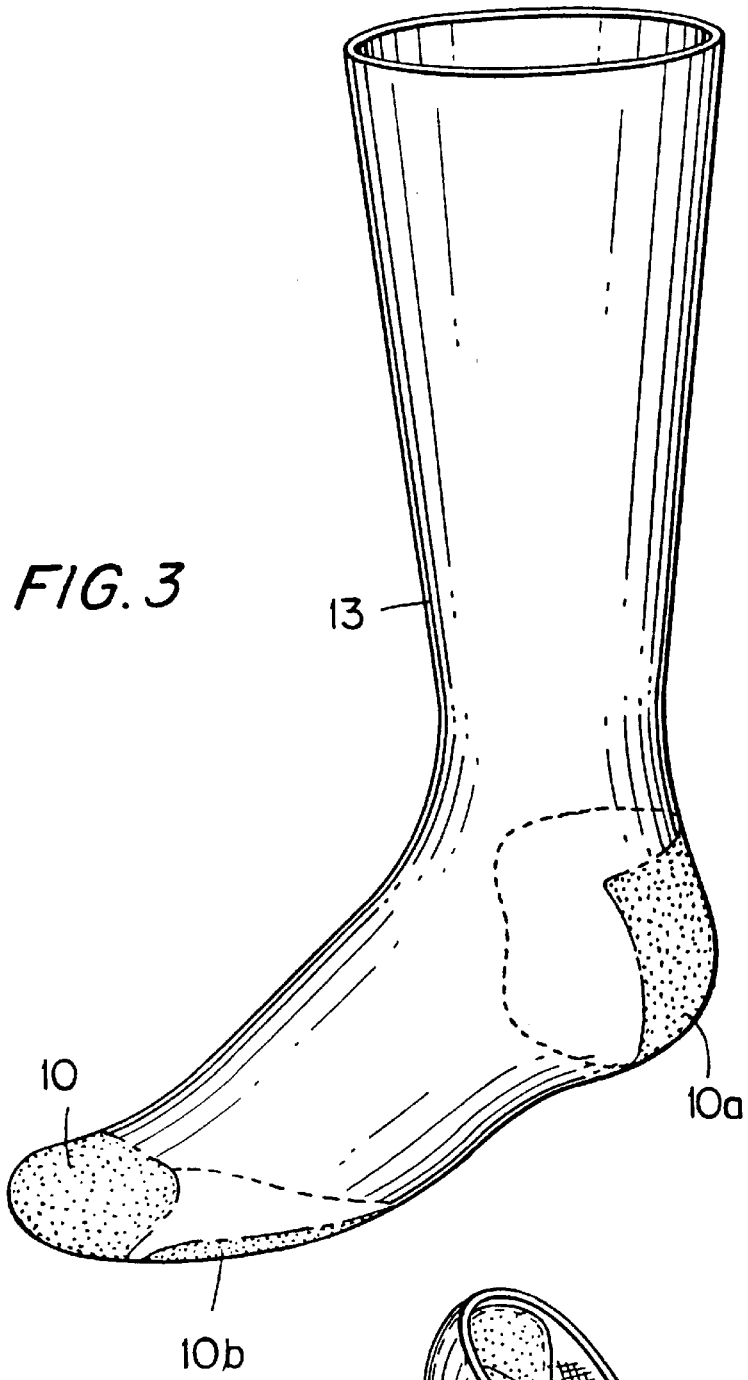
FIG. 3 is a perspective view of a sock or hosiery of the invention.

In one embodiment, low friction socks as shown in FIG. 3 or hosiery can be produced by incorporating low friction material overall or in specific high contact areas such as in the heel area, 10*a* (FIG. 3) the area around the pad of the sole of the foot, 10*b* (FIG. 3) the area extending from the pad of the foot to the right and left sides of the foot, in the region where the foot is the widest, and the area around the toes 10 (FIG. 3). Areas of the foot which contact laces, buckles or straps are also contact areas where protection would be utilized. The low friction material can also be incorporated to the outside of the sock which reduces friction between the sock and the outer foot apparel, such as a shoe. The low friction material can be incorporated to the inside of the sock which reduces friction between the wearer's foot and the sock. Additionally, low friction material can be incorporated to both inside and outside of the sock which, of course, simultaneously reduces friction between the sock and the outer footwear, and the wearer's foot and the sock.

EXAMPLE 2

In another embodiment, outer footwear such as a shoe, sneaker, boot, ski boot, sandal, slipper and the like, can have low friction material incorporated into the outer footwear fabric lining at high body surface/apparel contact areas thereby reducing friction between the wearer's foot or sock and the footwear. It is also noted that in footwear which has no fabric lining, the footwear material itself, such as leather, can be treated with low friction coefficient chemicals in high body surface/apparel contact areas 10, 21 (FIG. 9) to have a similar result.

Figure 9:
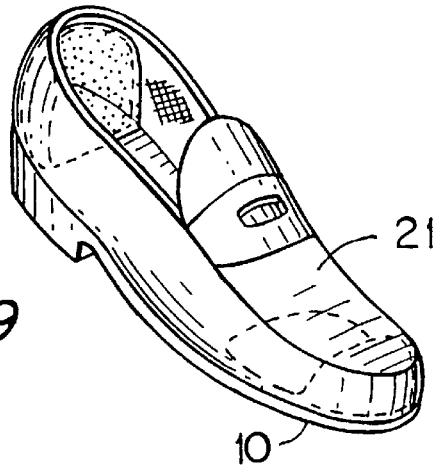
FIG. 9 is a perspective view of a footwear of the invention.

The low friction material is particularly useful in areas where the product would rub against the skin and cause irritation, blisters or callouses. In feet, these areas would be the heel, sole, the pads of the feet at the wide portion of the foot as shown in FIG. 9 or the top of the foot which contacts laces, buckles or straps.

EXAMPLE 3

Figure 8:
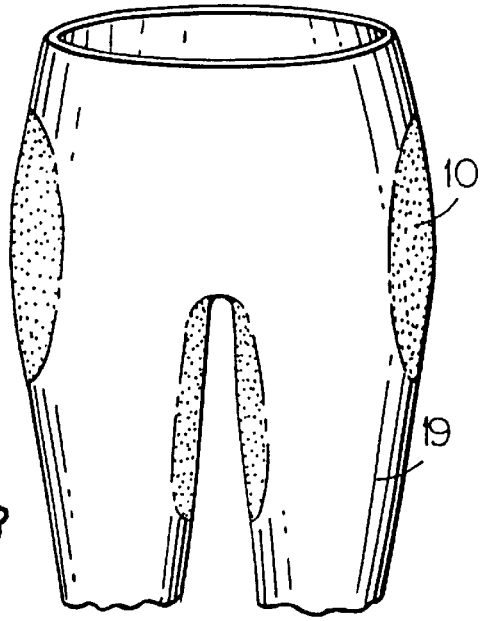
FIG. 8 is a perspective view of an athletic wear of the invention.

In a further embodiment, sporting apparel, such as warm-up pants, shorts, jogging suits, bicycle pants, wet suits, work pants and the like, can have low friction material 10 (FIG. 8) incorporated into high body surface/apparel contact areas such as the groin area and along the seams, such as the inner thigh seam, to avoid rubbing and irritations as shown in FIG. 8. Additionally, sporting apparel, such as sport shirts, warm-up shirt, and the like, can have low friction material incorporated into high body surface/apparel contact areas such as the neck and underarm areas to also avoid rubbing and irritations.

EXAMPLE 4

Figure 2:
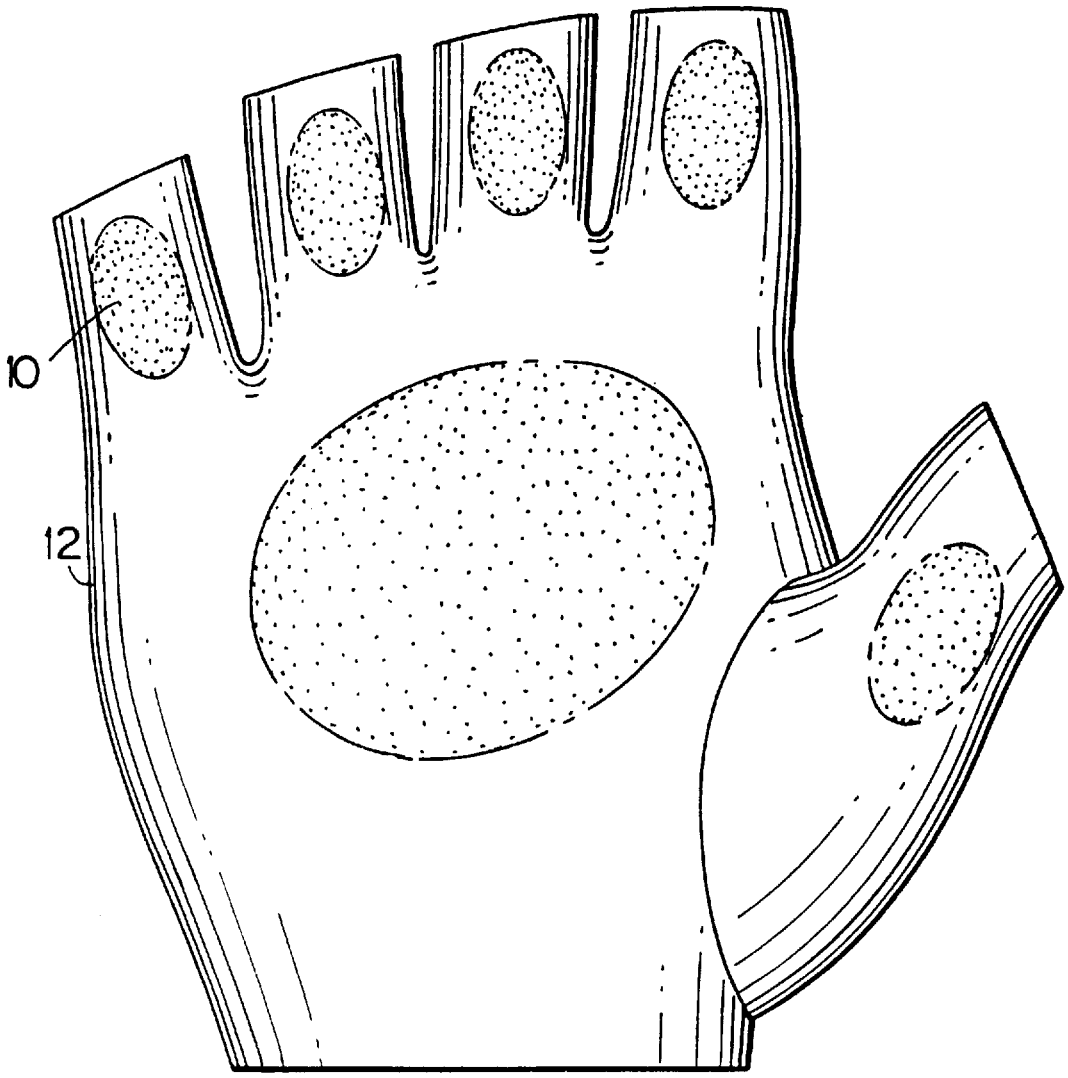
FIG. 2 is a front view of an alternative embodiment of the glove of the invention.

In yet another embodiment, work and sport gloves as shown in FIGS. 1–2 such as gloves used with tools, golf clubs, baseball bats, polo mallets, and tennis, squash and racquetball racquets, can have low friction material incorporated the glove 10, 11 (FIG. 1) and 10, 12 (FIG. 2) at high body surface/apparel contact areas to avoid blisters and callouses on the hands.

EXAMPLE 5

Figure 4:
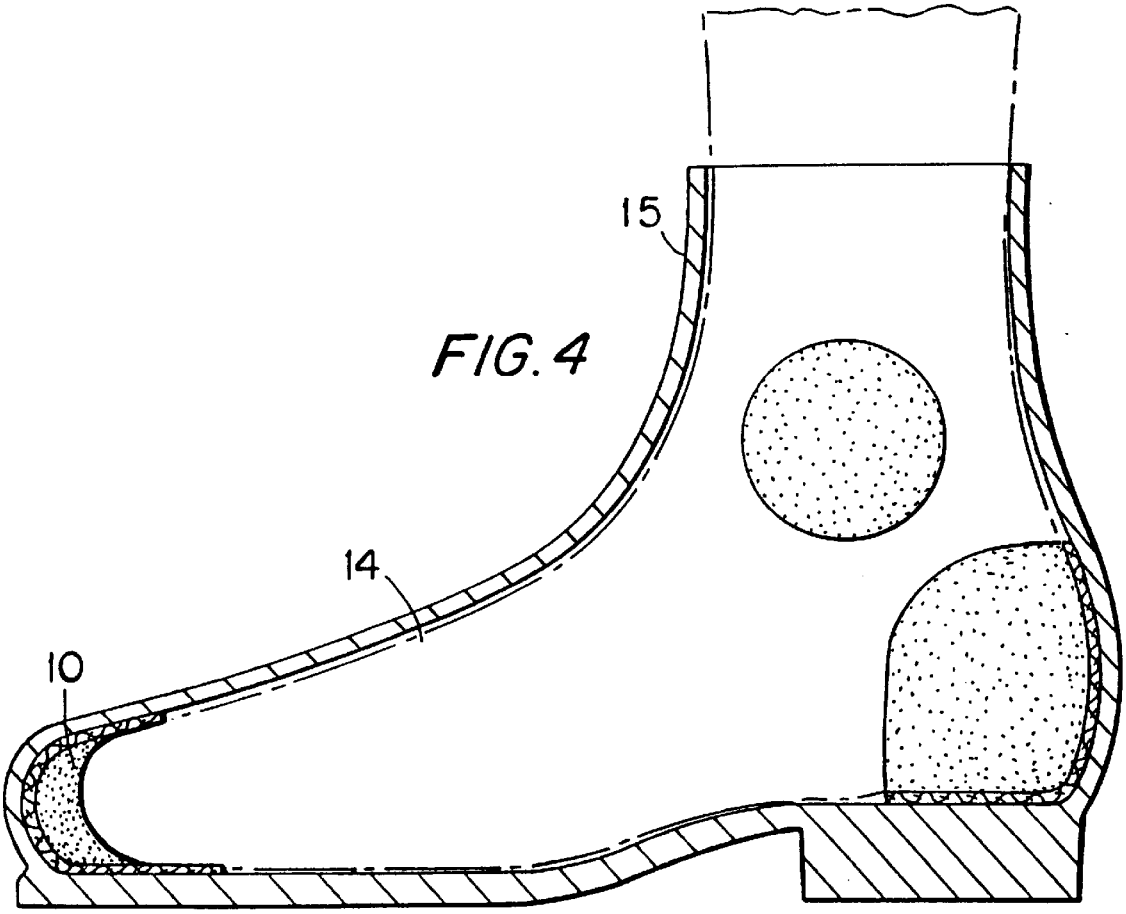
FIG. 4 is a cross sectional view of a foot insert of the invention.
Figure 4A:
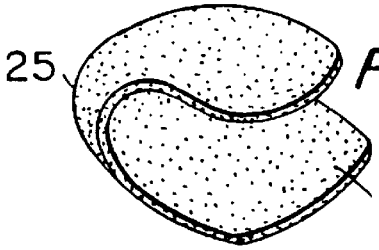
FIG. 4A is a perspective view of a toe insert of the invention.
Figure 4B:
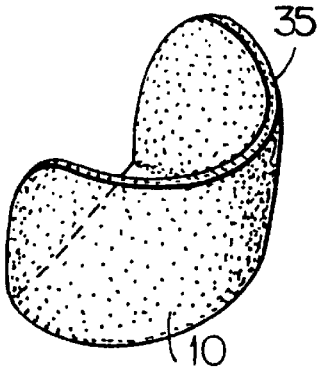
FIG. 4B is a perspective view of a heel cup insert of the invention.
Figure 4C:
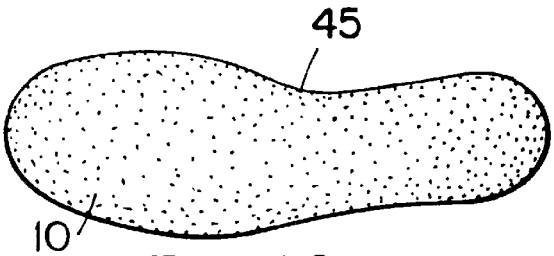
FIG. 4C is a bottom plan view of a shoe insert of the invention.
Figure 4D:
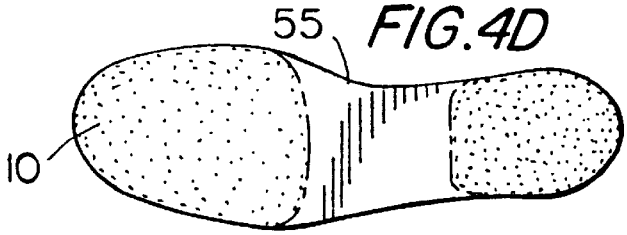
FIG. 4D is a bottom plan view of an alternative shoe insert of the invention.

The low friction material can be utilized in footwear inserts 10, 14, 15 (FIG. 4); 10, 25 (FIG. 4A); 10, 35 (FIG. 4B); 10, 45 (FIG. 4C); and 10, 55 (FIG. 4D) as shown in FIGS. 4A–4D, and other devices as shown in FIG. 4, made to fit in traditional footwear that will help avoid blisters and callouses by reducing friction of the foot against the pressure areas of footwear such as heel cushions 10, 25 (FIG. 4A), insoles, 10, 45 (FIG. 4C) and 10, 55 (FIG. 4D) orthotics, cushions and other pads (bandages).

EXAMPLE 6

Figure 5:
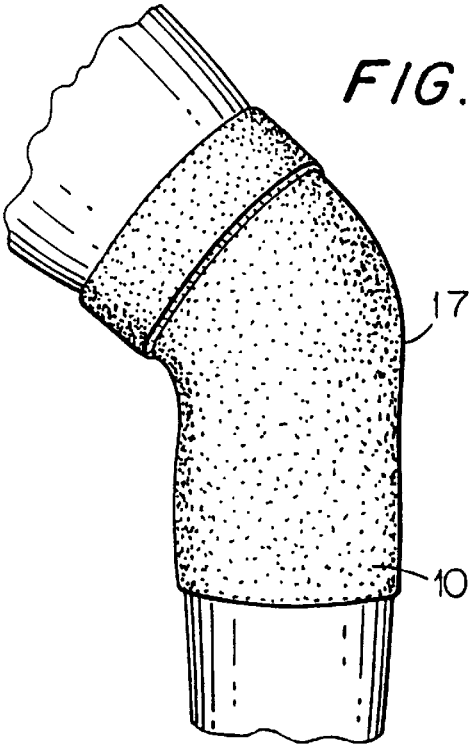
FIG. 5 is a perspective view of a knee bandage of the invention.
Figure 6:
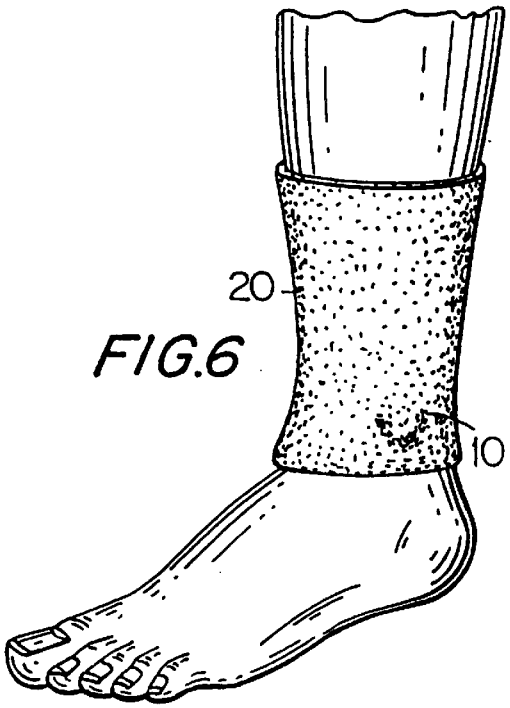
FIG. 6 is a perspective view of an ankle bandage of the invention.
Figure 7:
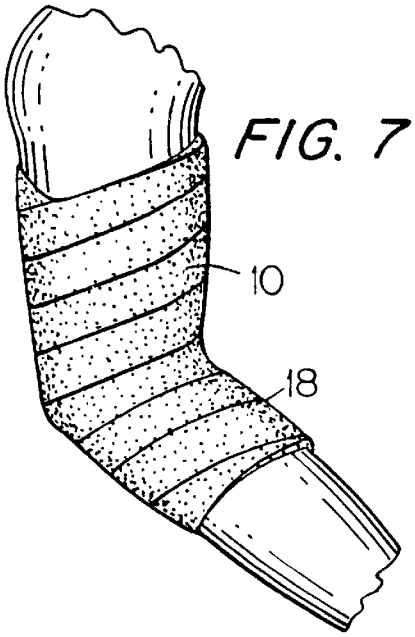
FIG. 7 is a perspective view of an elbow bandage of the invention.

The low friction material can also be used in bandages and wraps as shown in FIGS. 5–7, which support torn and sore muscles, ligaments and joints and as linings for casts 10, 17 (FIG. 5); 10, 20 (FIG. 6) and 10, 18 (FIG. 7).

EXAMPLE 7

The low friction material can be incorporated into covers for sporting equipment and tools and other devices that one uses that could cause irritation, blisters, callouses or soreness from friction.

Handles of baseball bats, handles of tennis and racquetball racquets, shovels, picks, construction and garden tools, hammers, screwdrivers, pliers, etc, handles of ski poles, fishing rods, water ski rope grips and towing ropes, golf clubs, archery bows, bicycle seats, car seats and back seats, weights and exercise equipment, etc., are all areas which can be incorporated with the low friction material.

It is understood that the invention is not limited to human apparel. The invention can also be used in horse blankets, pet apparel, and the like.

Also as indicated above, the present invention provides apparel with a low friction outer surface to minimize the fictional effect of apparel outer surface/external object contact. Apparel with a low friction outer surface can be made with a low friction materials 10 (FIG. 1–9). These low friction materials can be fibers which inherently have a low coefficient of friction which are incorporated into the material either alone or in combination with other materials; low friction chemicals which can be applied directly to the finished fibers, material, or apparel to impart low friction properties; fibers which are treated with a low friction chemicals then woven into the material either alone or in combination with other material; or any combination of the above. These low friction materials can be incorporated into the entire exterior surface of the apparel or in specific high apparel surface/external object or surface contact.

The above mentioned low coefficient of friction materials can be incorporated directly into the apparel either overall or in specific high apparel surface/external object or surface contact areas to produce apparel with a low friction outer surface.

The chemicals treatment techniques discussed above also apply to producing low friction outer surface apparel.

In a typical application of the invention, a fiber, yarn or fabric or finished article (such as apparel) is treated with the low coefficient of friction material to reduce the coefficient of friction of the treated fiber, yarn, fabric or article to one which is below the coefficient of friction of the untreated fiber, yarn, fabric or finished article.

It is preferred that the coefficient of friction of the treated object be less than about 80%, preferably less than about 60% and most preferably less than about 50% of the coefficient of friction of the untreated object.

If the low friction material is incorporated into the finished article or fabric by weaving a low friction fiber or yarn into the article or fabric, the low friction fiber or yarn can be incorporated into amounts ranging from 5% to 95% by weight of the treated area. Preferably, the fiber or yarn is incorporated in amounts between 30 and 70% by weight of the treated area. Most preferably, these amounts are 30 to 50%, by weight.

It is of course understood that when finished material is treated with chemicals to impart a low coefficient of friction, in particular when spraying onto the material, the amount incorporated into the finished material can be as small as a fraction of a percent by weight of the treated area.

The addition of the low friction material to the fiber, yarn, fabric or article can also be useful to wick away moisture from the skin to help guard against irritation, as well as wetness.

It is of course understood that apparel can be produce with both low friction body surface/apparel areas which avoids or minimizes the development of irritations, blisters, and callouses and low friction outer surface/external object contact such that frictional contact is minimized.

It is preferred that areas of apparel treatment are typically areas which would ordinarily come in contact with the external contact surface during use.

It is preferred also that the coefficient of friction between the treated area of the apparel and the external contact surface to be reduced to below about 0.9. Most preferably, the coefficient of friction is reduced to below about 0.6.

The following examples are set forth to illustrate specific embodiments of the apparel with a low friction outer surface.

EXAMPLE 8

Figure 10A:
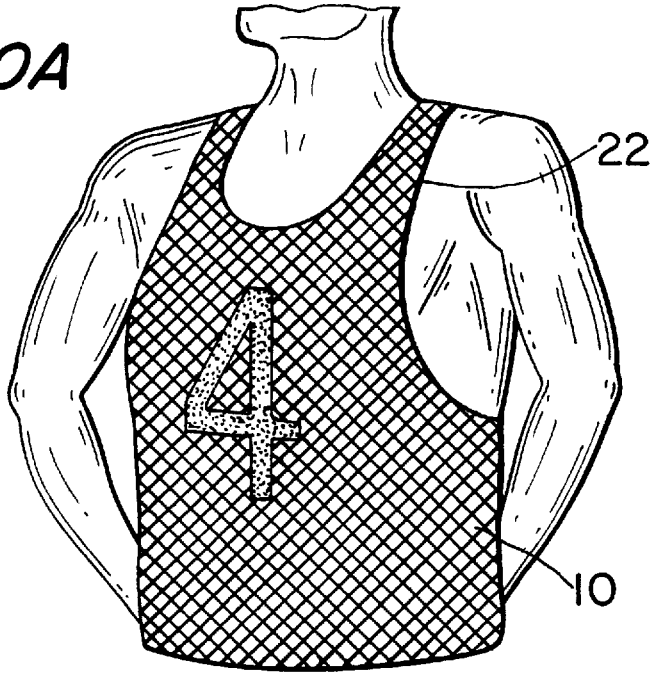
FIG. 10A is a front view of a sports uniform of the invention.
Figure 10B:
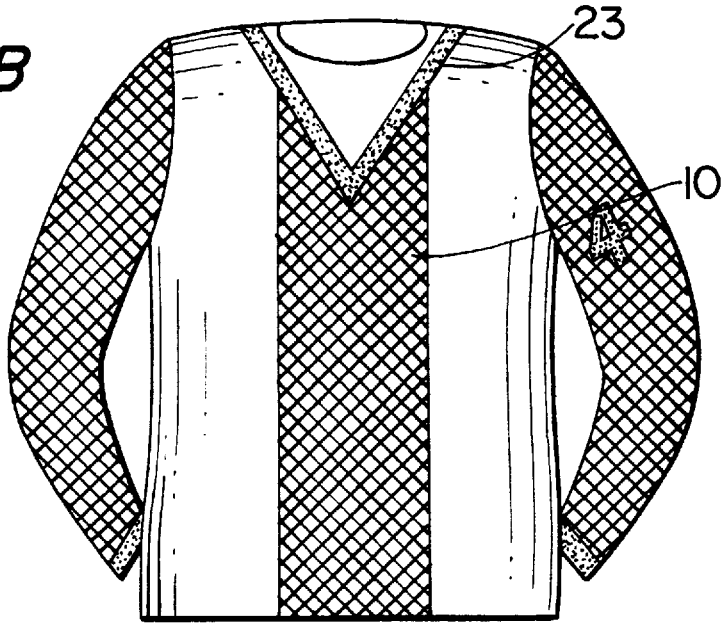
FIG. 10B is a front view of an alternative embodiment of the sports uniform of the invention.
Figure 11:
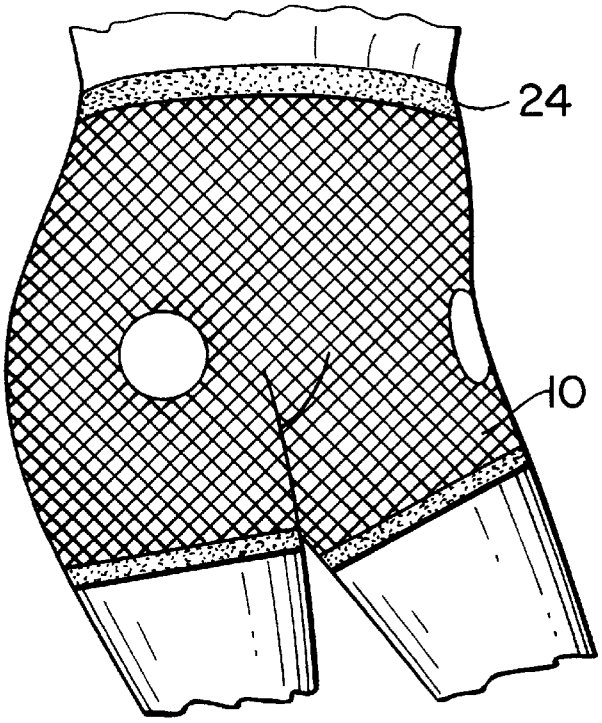
FIG. 11 is a perspective view of sports protection apparel of the invention.
Figure 12A:
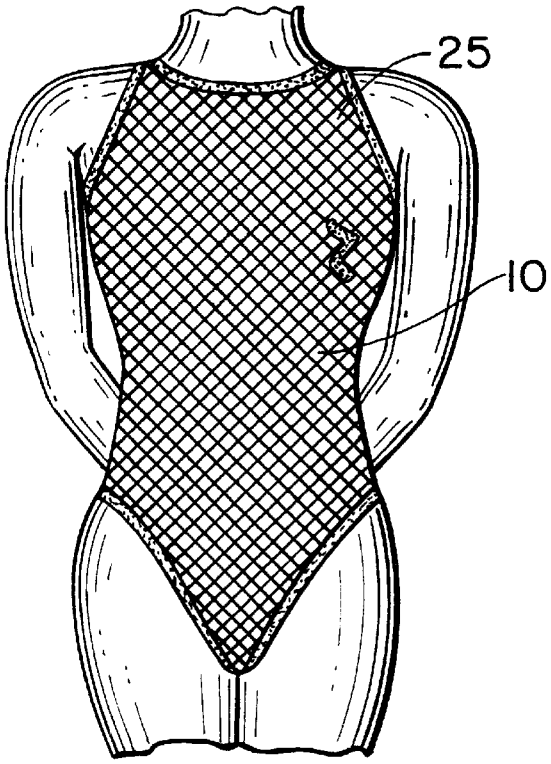
FIG. 12A is a front view of a water apparel of the invention.
Figure 12B:
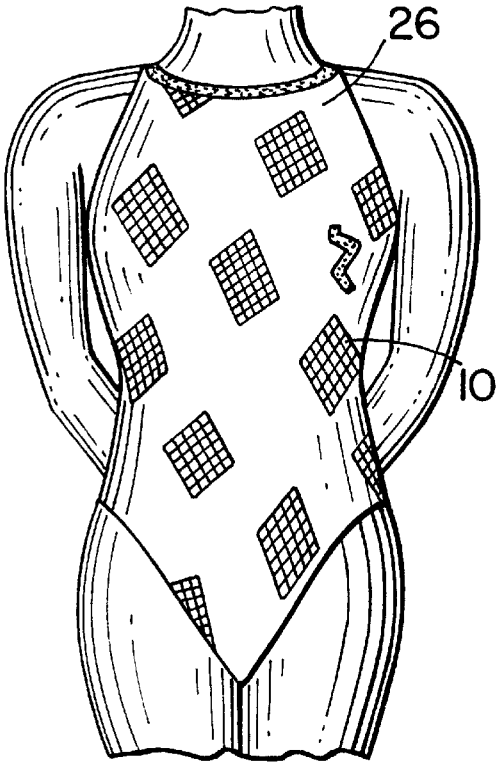
FIG. 12B is a front view of an alternative embodiment of the water apparel of the invention.

In one embodiment, sporting apparel, such as uniforms used in football, wrestling, and rugby where an opponent tackled or gripped during play, can have low friction material incorporated directly into the apparel either overall as shown in FIG. 10A, or in specific surface contact areas as shown in FIG. 10B, to produce apparel with a low friction outer surface which is difficult to grip to make it hard to tackle or handle the opponent.

Additionally, sporting apparel, such as uniforms used in football, baseball, basketball, wrestling, racquetball, squash, rugby, soccer, lacrosse, hockey, field hockey, and handball, where players (either opposing players or team members) make bodily contact, can have low friction material incorporated directly into the apparel either overall 10, 22 (FIG. 10A) or in specific surface contact areas 10, 23 (FIG. 10B) to produce apparel with a low friction outer surface to minimize the effect of pushing and jostling of contact during play.

EXAMPLE 9

In another embodiment, sports protection apparel, such as knee pads, elbow pads, and hand protection used in volleyball, basketball, skating (particularly in-line skating), skateboarding, and soccer, can have low friction material incorporated directly into the protection apparel either overall 10, 24 (FIG. 11) or in specific surface contact areas to reduce injuries which occur in these sports.

In general, frictional contact of any object with air, water, or solid surfaces slows or brings a moving object to a stop. This frictional contact is particularly a problem in sports where a participant's bodily momentum is brought to an abrupt or sliding halt. If the bodily momentum is dissipated by a sliding motion which would occur from the incorporation of low friction material, injuries which occur in these sports could be minimized.

EXAMPLE 10

In a further embodiment, sporting apparel, such as used in sports where friction is very undesirable. In high speed sports and sports where the difference between winning and losing is determined in fractions of a second such as swimming, running, and downhill or ultimate downhill skiing, low friction material can be incorporated directly into the apparel either overall 10, 25 (FIG. 12A) or in specific surface contact areas 10, 26 (FIG. 12B) to produce apparel with a low friction outer surface to minimize frictional contact with air or water.

Additionally, low friction material can be incorporated into water apparel such as wet suits to minimize frictional contact with water.

It is also understood that the invention is not restricted to the detailed description of the invention, which may be modified without departure from the accompanying claims.

What is claimed is:

1. A method for producing a treated article of clothing which is adapted to be worn by user and to be in contact with a surface of an external object wherein frictional contact between an outer surface of the article and the surface of the external object is reduced, comprising the steps of:

weaving a material having a low coefficient of friction characteristic which is of a non-temporary nature into a treated area of the article of clothing at a specific area of high article outer surface to external surface contact, the coefficient of friction of the specific area of high article to external surface contact of the treated article of clothing being less than about 80% of the coefficient of friction of an untreated area of the article clothing.

2. The method of claim 1 wherein the article of clothing is a sports apparel used for swimming and an area of high outer surface to external surface contact includes an outer surface of the sports apparel.

3. The method of claim 1 wherein the article of clothing is sports apparel and an area of high article outer surface to external surface contact includes at least an arm area, an elbow area, a chest area, a leg area, a knee area, a thigh area or a crotch area.

4. The method of claim 1 wherein the coefficient of friction of the treated article of clothing is less than about 60% of the coefficient of friction of the untreated article of clothing.

5. They method of claim 4 wherein the coefficient of friction of the treated article of clothing is less than about 50% of the coefficient of friction of the untreated article of clothing.

6. The method of claim 1 wherein the material having a law coefficient of friction characteristic includes silicone, silicone copolymers, silicone elastomers, polytetrafluoroethylene, homopolymers and copolymers, graphite, boron, polypropylene or polyethylene.

7. The method of claim 6 wherein the low coefficient of friction material is polytetrafluoroethylene or homopolymers or copolymers thereof.

8. The method of claim 1 wherein the coefficient of friction of the article of clothing at a specific area of high article outer surface to external surface contact is less than 0.6.

9. The method of claim 1 wherein the article of clothing is sports apparel.

10. An article of clothing having an outer surface, the outer surface of the article of clothing having a treated area and an untreated area, the treated area including an area of high article outer surface to an external surface contact and the untreated area including a remaining portion of the article of clothing, the treated area including at least an arm area, an elbow area, a chest area, a leg area, a knee area, a thigh area or crotch area of the article of clothing the treated area having incorporated therein a non-temporary material having a low coefficient of friction characteristic that imparts to the treated area a coefficient of friction which is less than about 80% of the coefficient of friction of the untreated area.

11. The article of clothing of claim 10 wherein the coefficient of friction between the treated area and the external surface is less than 0.6.

12. The article of clothing of claim 10, wherein the material incorporated into the treated area of the sports apparel comprises a polytetrafluoroethylene yarn or fiber.

13. The article of clothing of claim 10 wherein the article of clothing is sports apparel, and the material having a low coefficient of friction characteristic is woven into the sports apparel.

14. The article of clothing of claim 13 wherein the article of clothing in apparel used in water sports.

15. The article of clothing of claim 14 wherein the apparel is a swimsuit, wet suit or sailing suit.

16. The article of clothing of claim 13 wherein the sports apparel is a sport protection apparel.

17. The article of clothing of claim 16 wherein the sport protection apparel is a knee pad, elbow pad, wrist pad or head gear.

18. The article of clothing of claim 13 wherein the sports apparel is a football, baseball, basketball, wrestling, soccer, hockey, handball or skiing uniform.

19. The article of clothing of claim 10, wherein the material having a low coefficient of friction characteristic includes silicone, silicone copolymers, silicone elastomers, polytetrafluoroethylene or homopolymers and copolymers thereof, graphite, boron, polypropylene or polyethylene.

20. The article of clothing of claim 19 wherein the material having a low coefficient of friction characteristic includes polytetrafluoroethylene or homopolymers and copolymers thereof.

21. The article of clothing of claim 13 wherein the sports apparel is used for swimming.

22. The article of clothing of claim 13 wherein the sports apparel is used for running.

23. The article of clothing of claim 10, wherein the coefficient of friction is less than about 60% of the coefficient of friction of the untreated area.

24. The article of clothing of claim 23, wherein the coefficient of friction is less than about 50% of the coefficient of friction of the untreated area.

25. A method for producing a treated article of clothing which is adapted to be worn by user and to be in contact with a surface of an external object wherein frictional contact between an outer surface of the article and the surface of the external object is reduced, comprising the steps of:

weaving a non-temporary material having a low coefficient of friction characteristic into the overall article of clothing the coefficient of friction of the overall area of the treated article of clothing being less than about 80% of the coefficient of friction of an untreated article of clothing.

26. The method of claim 25 wherein the article of clothing is sports apparel.

27. This method of claim 25 wherein the coefficient of friction of the article of clothing at the area of article outer surface to external surface contact is less than 0.6.

28. They method of claim 25 wherein the coefficient of friction of the treated article of clothing is less than about 60% of the coefficient of friction of the untreated article of clothing.

29. The method of claim 28 wherein the coefficient of friction of the treated article of clothing is less than about 50% of the coefficient of friction of the untreated article of clothing.

30. The method of claim 25 wherein the material having a low coefficient of friction characteristic includes silicone, silicone copolymers, silicone elastomers, polytetrafluoroethylene, homopolymers and copolymers, graphite, boron, polypropylene or polyethylene.

31. The method of claim 30 wherein the low coefficient of friction material is polytetrafluoroethylene or homopolymers or copolymers thereof.

32. A treated article of clothing adapted to be worn by a user having an overall area of the article of clothing in contact with an external surface, the overall area having woven therein a non-temporary material having a low coefficient of friction characteristic which imparts to the treated article of clothing a coefficient of friction which is less than about 80% of the coefficient of friction of an untreated article of clothing.

33. The article of clothing of claim 32, wherein the material having a low coefficient of friction characteristic includes silicone, silicone copolymers, silicone elastomers, polytetrafluoroethyylene or homopolymers and copolymers thereof, graphite, boron, polypropylene or polyethylene.

34. The article of clothing of claim 33 wherein the article of clothing is a sport protection apparel.

35. The article of clothing of claim 34 wherein the sport protection apparel is a knee pad, elbow pad, wrist pad or head gear.

36. The article of clothing of claim 33, wherein the article of clothing is sports apparel, and the material having a low coefficient of friction characteristic is polytetrafluoroethylene or homopolymers or copolymers thereof.

37. The article of clothing of claim 36 wherein sports apparel is for water sports.

38. The article of clothing of claim 39 wherein the apparel is a swimsuit, wet suit or rain suit for sailing.

39. The article of clothing of claim 36 wherein the sports apparel is a football, baseball, basketball, wrestling, soccer, hockey, handball or skiing uniform.

40. The article of clothing of claim 36 wherein polytetrafluoroethylene is a fiber or yarn.

41. The article of clothing of claim 32 wherein the coefficient of friction is less than about 60% of the coefficient of friction of the untreated article of clothing.

42. The article of clothing of claim 41, wherein the coefficient of friction is less than about 50% of the coefficient of friction of the untreated article of clothing.

43. The article of clothing of claim 32, wherein the external surface is air, water or solid surfaces.

44. An article of sporting apparel having a treated area and an untreated area in contact with a body surface of a user and in contact with an external surface of an external object, wherein a non-temporary low coefficient of friction material is incorporated into the treated area to reduce frictional contacts between the apparel and the body surface and the apparel and the external surface.

45. The apparel of claim 44, wherein the non-temporary low coefficient of friction material is woven into the treated area.

46. The apparel of claim 44, wherein the non-temporary low coefficient of friction material includes low friction chemicals applied directly to a finished fibers to impart low friction properties.

47. The apparel of claim 46, wherein the treated area includes at least portions of a torso area, inner thigh area, or groin area.

48. The apparel of claim 47, wherein the coefficient of friction between the treated area of the clothing and the external surface is less than about 0.6.

49. The apparel of claim 47, wherein the coefficient of friction between the treated area of the clothing and the body surface is less than about 0.6.

50. The apparel of claim 46, wherein the low coefficient of friction material imparts a coefficient of friction to the treated area which is less than 80% of the coefficient of friction of the untreated area of the apparel.

51. The apparel of claim 50, wherein the coefficient of friction of the treated area is less than about 60% of the coefficient of friction of the untreated area of the apparel.

52. The apparel of claim 51, wherein the coefficient of friction of the treated area is less than about 50% of the coefficient of friction of the untreated area of the apparel.

53. The apparel of claim 46, wherein the low coefficient of friction material is selected from the group consisting of silicone, silicone copolymers, silicone elastomers, polytetrafluoroethylene, homopolymers and copolymers thereof, graphite, boron, polypropylene and polyethylene.

54. The apparel of claim 53, wherein the low coefficient of friction material includes polytetrafluoroethylene or homopolymers or copolymers thereof.

55. The apparel of claim 54, wherein the material woven into the treated area comprises a polytetrafluoroethylene yarn or fiber.

56. The apparel of claim 55, wherein the material having a low coefficient of friction is polytetrafluoroethylene.

57. A method for producing an article of sporting apparel adapted to be in contact with a body surface of a user and in contact with an external surface of an external object, wherein frictional contacts between the clothing and the body surface of the user and between the clothing and the external surface are reduced, comprising the step of:

weaving a material having a low coefficient of friction characteristic which is of a non-temporary nature into the article of clothing having a treated area and an untreated area, the treated area being at an area of high body to clothing contact and at an area of a high clothing to external surface contact.

58. The method of claim 57, wherein the treated area of high body to clothing contact includes at least portions of a torso area, inner thigh area, or crotch area.

59. The method of claim 58, wherein the material having a low coefficient of friction characteristics is selected from the group consisting of silicone; silicone copolymers; silicone elastomers; polytetrafluorbethylene; homopolymers and copolymers thereof; graphite; boron; polypropylene and polyethylene.

60. The method of claim 59, wherein the low coefficient of friction material is polytetrafluoroethylene or homopolymers or copolymers thereof.

61. The method of claim 60, wherein the material woven into the treated area comprises a polytetrafluoroethylene yarn or fiber.

62. The method of claim 57, wherein the coefficient of friction of the treated area is less than about 80% of the coefficient of friction of an untreated area of the article of clothing.

63. The method of claim 62, wherein the coefficient of friction of the treated area is less than about 60% of the coefficient of friction of the untreated area of the article of clothing.

64. The method of claim 63, wherein the coefficient of friction of the treated area is less than about 50% of the coefficient of friction of the untreated area of the article of clothing.

* * * * *